United States Patent [19]

Hoshiba

[11] Patent Number: 4,570,744

[45] Date of Patent: Feb. 18, 1986

[54] INTAKE SILENCER FOR MARINE PROPULSION DEVICE

[75] Inventor: Akihiko Hoshiba, Hamamatsu, Japan

[73] Assignee: Sanshin Kogyo Kabushiki Kaisha, Hamamatsu, Japan

[21] Appl. No.: 655,216

[22] Filed: Sep. 27, 1984

[30] Foreign Application Priority Data

Sep. 29, 1983 [JP] Japan ..... 58-179296

[51] Int. Cl.[4] ..... F01N 1/02

[52] U.S. Cl. ..... 181/204; 181/269; 440/89

[58] Field of Search ..... 181/204, 212, 229, 233, 181/235, 240, 269, 272, 205; 440/89

[56] References Cited

U.S. PATENT DOCUMENTS 2,971,507 2/1961 Kiekhaeger ..... 181/204 X

*Primary Examiner*—Benjamin R. Fuller

*Attorney, Agent, or Firm*—Ernest A. Beutler

[57] ABSTRACT

An improved induction system silencing device for an outboard motor having an engine and a surrounding protective cowling comprising a baffle plate positioned within the protective cowling for forming a resonance chamber.

4 Claims, 2 Drawing Figures

INTAKE SILENCER FOR MARINE PROPULSION DEVICE

BACKGROUND OF THE INVENTION

This invention relates to an intake silencer for an outboard motor and more particularly to an improved silencing device for the induction system of an outboard motor.

As is well known, outboard motors incorporate a power head which contains an internal combustion engine and the engine is normally surrounded by a protective cowling. A device is provided for permitting inlet air to be drawn through the protective cowling into the engine induction system. Normally, some form of intake silencer incorporating a expansion and/or resonance chamber is provided for the induction system of the engine. However, because of the extremely compact nature of outboard motors, the silencing device must be relatively small. This frequently makes it difficult to silence all induction system noises, and particularly low frequency noises, and this is particularly undesirable because of the fact that the motor and specifically the engine is normally positioned in close proximity to the operator.

It is, therefore, a principal object of this invention to provide an improved and yet compact silencing device for an outboard motor.

It is another object of the invention to provide an improved silencing system for the induction system of an outboard motor.

SUMMARY OF THE INVENTION

This invention is adapted to be embodied in an outboard motor having a power head comprised of an internal combustion engine and a surrounding protective cowling. The engine induction system includes an intake silencer that draws inlet air from the volume between the outer periphery of the engine and the inner periphery of the protective cowling. In accordance with the invention, a baffle plate is provided within this volume for dividing it into sectors and providing an area for reflection of sound waves within the outer cowling.

DETAILED DESCRIPTION OF THE PREFERRED EMBODIMENT

Figure 1:
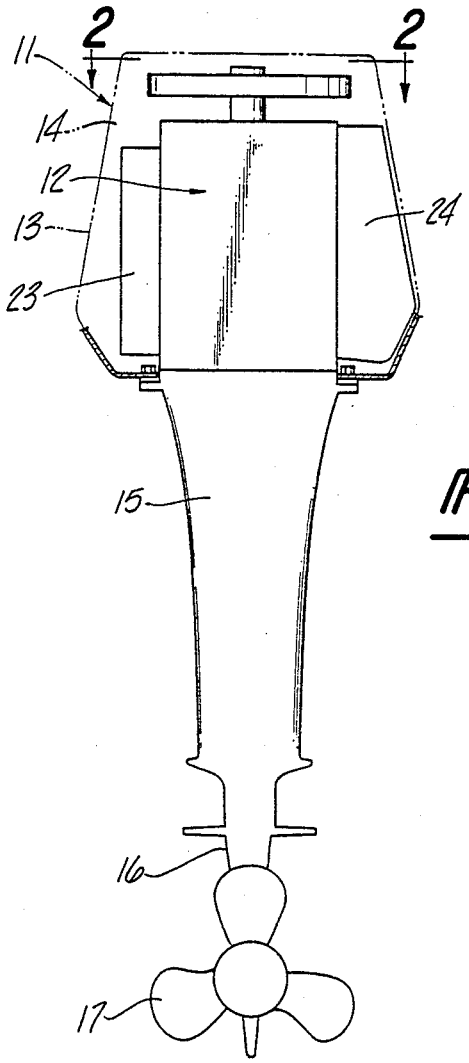
FIG. 1 is a rear elevational view of an outboard motor constructed in accordance with the invention, with a portion broken away and shown in phantom.

An outboard motor constructed in accordance with an embodiment of the invention is identified generally by the reference numeral 11. The motor 11 consists of a power head that comprises an internal combustion engine 12 and a surrounding protective cowling, which is partially shown in phantom in FIG. 1 and is identified by the reference numeral 13. An air volume 14 is contained within the area surrounding the outer periphery of the engine 12 and the inner periphery of the cowling 13.

A drive shaft housing 15 depends from the power head and carries a lower unit 16 in which a propeller 17 is rotatably supported and journaled. The engine 12 drives the propeller 17 in a known manner.

The engine 12 is provided with an induction system including a silencing device 18 which may be of any known type including one with one or more expansion and/or resonance chambers. An air inlet 19 in the inlet device 18 opens into the volume 14 and draws induction system air from this volume. This air is fed to a charge forming device such as a carburetor 21.

The volume 14 communicates with the atmosphere through an appropriate air inlet opening which may comprise a rearwardly opening air inlet 22.

The engine 12 is also provided with an exhaust system that includes an exhaust pipe baffle plate 23 for covering a portion of the exhaust system.

Figure 2:
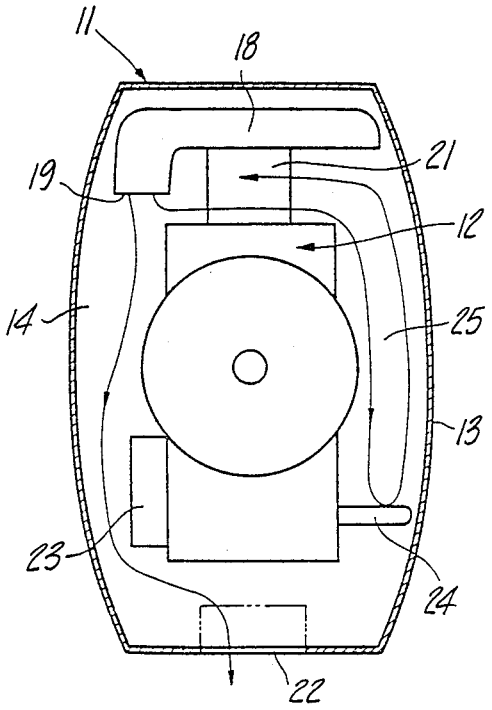
FIG. 2 is an enlarged cross-sectional view looking in the direction of the arrows 2—2 in FIG. 1.

Although the inlet device 18 is intended to provide some intake air silencing, there will be nevertheless sounds which emanate from it and which can pass to the atmosphere through the opening 22 as shown by the arrows in this figure. In order to reduce such sound transmission and to provide further silencing, a baffle plate 24 is contained within the volume 14 for breaking up this volume and also for reflecting the sound waves back from the inlet device 18 toward the front of the cowling as shown by the arrows in FIG. 2. In effect, the baffle plate 24 also provides a further resonance chamber 25 so as to further assist in the induction system silencing.

Although the baffle plate 24 is illustrated as being affixed to the engine 12, it should be readily apparent that it can be fixed to or form a part of the protective cowling 13. Furthermore, one or more baffle plates may be employed. Various other changes and modifications may be made, without departing from the spirit and scope of the invention, as defined by the appended claims.

I claim:

1. An induction silencing system for an outboard motor or the like comprising a power head consisting of an internal combustion engine and a surrounding protective cowling defining a generally open volume surrounding said engine, said engine having an induction system consisting of an inlet device drawing air from said volume between the outer periphery of the engine and the inner periphery of the protective cowling, an air inlet opening for admitting external air into said volume, the improvement comprising a baffle positioned within said volume and defining a resonance chamber within the protective cowling where sounds emanating from said inlet device toward said baffle will be reflected back toward said inlet device before they can escape from said air inlet opening to the atmosphere around said protective cowling.

2. An induction silencing system as set forth in claim 1 wherein the inlet device is provided at the forward end of the cowling and the air inlet opening is formed at the rear end of the protective cowling, the baffle plate being positioned closer to the rear end than the front end of the protective cowling.

3. An induction silencing system as set forth in claim 2 wherein the baffle plate is affixed to the engine.

4. An induction silencing system as set forth in claim 2 wherein the baffle plate is affixed to the protective cowling.

* * * * *